US010479449B2

(12) United States Patent
Cooper

(10) Patent No.: US 10,479,449 B2
(45) Date of Patent: Nov. 19, 2019

(54) INFLATABLE WATERCRAFT AND METHOD OF MAKING SAME

(71) Applicant: BOTE, LLC, Fort Walton Beach, FL (US)

(72) Inventor: Corey Cooper, Fort Walton Beach, FL (US)

(73) Assignee: BOTE, LLC, Fort Walton Beach, FL (US)

( * ) Notice: Subject to any disclaimer, the term of this patent is extended or adjusted under 35 U.S.C. 154(b) by 0 days.

(21) Appl. No.: 15/904,999

(22) Filed: Feb. 26, 2018

(65) Prior Publication Data

US 2019/0263475 A1 Aug. 29, 2019

(51) Int. Cl.
*B63B 7/00* (2006.01)
*B63B 7/08* (2006.01)

(52) U.S. Cl.
CPC ..... *B63B 7/082* (2013.01); *B63B 7/087* (2013.01)

(58) Field of Classification Search
CPC .. B63B 7/00; B63B 7/08; B63B 7/082; B63B 7/085; B63B 7/087; B63B 2007/00; B63B 2007/003; B63B 2007/006; B63B 2007/06; B63B 2007/065
USPC .... 114/343, 345, 354, 361, 364; 441/40–42, 441/66
See application file for complete search history.

(56) References Cited

U.S. PATENT DOCUMENTS

| | | | | |
|---|---|---|---|---|
| 4,251,893 | A | 2/1981 | McCrory et al. | |
| 7,861,662 | B2 * | 1/2011 | Rista | B63B 7/08 114/345 |
| 8,082,871 | B2 * | 12/2011 | Czarnowski | B63B 35/71 114/345 |
| 8,834,220 | B2 * | 9/2014 | Haller | B63B 35/7913 114/140 |
| 9,114,862 | B2 * | 8/2015 | Dingel | B63B 35/7913 |
| 9,637,201 | B2 | 5/2017 | Hoge, Jr. | |
| 9,862,466 | B2 * | 1/2018 | Hall | B63B 35/7913 |

OTHER PUBLICATIONS

Bote, LLC, Rackham Aero Inflatable Paddle Board, as retrieved from https://www.boteboard.com/products/catalog/aerobotes/rackham/ on Jan. 2, 2019, first disclosed 2015 (5 pages).

* cited by examiner

*Primary Examiner* — Daniel V Venne
(74) *Attorney, Agent, or Firm* — Smith, Gambrell & Russell, LLP

(57) ABSTRACT

A watercraft is made of at least two inflatable members, each being made of a drop-stitch which provides strength and stiffness comparable to a solid material. Air pressures of twenty to thirty pounds are possible with drop-stitch material. Using near net shape structures, a cockpit is formed by stacking one inflatable member on top of the other. The two members are separately inflatable and bound together adhesively or with heat welding or tacking. Advantageously, the watercraft can function as both a board type watercraft or as a boat, capable of being paddled while standing up, or motored with an outboard motor.

10 Claims, 9 Drawing Sheets

INFLATABLE WATERCRAFT AND METHOD OF MAKING SAME

BACKGROUND OF THE INVENTION

The present invention relates generally to inflatable, lightweight and stowable watercraft, and more particularly, to inflatable watercraft that are made from separately inflatable sections that combine to form the basic features of a boat, including a bow, stern, engine well, cockpit and deck. Drop stitch material used for the inflatable sections renders the boat as comparably rigid as a solid material, non-inflatable boat.

DESCRIPTION THE RELATED ART

Inflatable boats are well known and come in a variety of sizes and shapes. Smaller inflatable boats are generally lightweight and have sides and a bow made of flexible tubes containing pressurized gas. Larger boats, such as those of length greater than ten feet, the floor may be supported by wooden, aluminum or fiberglass sections or slats, but they are not typically integrally formed with the material which comprises either the floor or the sides. It is also known to provide a rigid transom at the stern portion of the boat to support a suitably sized outboard motor. As such, many smaller inflatable boats can either be paddled with oars or driven by a motor.

Smaller inflatable boats have the advantage of being compact, when deflated, and stowable, advantageously for carrying in an automobile, or in a lazarette of a modern sailboat as a lifeboat and/or tender. Conventionally, small inflatable boats are inflated either by hand or foot pumps to pressures that range from one to just a few pounds per square inch (p.s.i.). Some maintain relative stiffness or rigidity cross-ways by a foldable or inflatable thwart, which is separate from the basic structure of the sidewalls, bow and floor. Also, floor slats may perform the same or partially the same function and provide support for standing on the floor.

While natural rubber was used to construct some of the earliest inflatable boats, today's more advanced inflatable boats are made using supported fabric. Typical constructions include rubberized, synthetic fabrics, using polyvinylchloride (PVC) and polyurethane. Depending on the choice of fabric, the fabric panels are assembled using either hot or cold manufacturing processes.

With the increasing popularity of water sports, inflatable watercraft are in greater demand today than ever. While inflatable kayaks and canoes have been known, a more recent development is the inflatable stand up paddle board or SUP. A SUP resembles a surf board, more so than a boat, but includes traditional boat analogs such as a deck, and bottom, and bow and a stern. However, with virtually no freeboard, a SUP is virtually flush with or slightly above the waterline when a user is standing, sitting or lying on the deck or upper surface. For that reason, the upper surface is typically provided with a traction pad which helps prevent slipping when someone is standing on the upper surface. A SUP has many uses, which accounts for their rapid growth in popularity: as a means of exercise, SUPs are paddled with a relatively long, single ended paddle or oar, and the paddling motion is extremely useful for working the back, stomach, shoulder and arm muscles, while at the same time, maintaining balance works the leg muscles. Aside from exercise, the SUP provides transportation much as a canoe, kayak or small boat, and a platform for sunbathing, fishing or nature gazing and photography.

To provide the proper amount of stiffness, and certainly enough to support the weight of a standing adult, inflatable SUPs are known to be made of a drop stitch inflatable material. Inflatable watercraft employing drop stitch material are generally known. For example, U.S. Pat. No. 4,251,893 to McCrory et al. describes an inflatable boat which includes a floor section made of drop stitch material. As described therein, the drop stitch construction includes fabric walls between which are interconnected a plurality of flexible threads. This construction generally allows inflation to much higher pressures, which provides a greater degree of stiffness and strength when compared to conventional inflatable materials.

In today's world of watercraft and water sports, there exists a gulf between boats and boards and their respective uses and activities. While boats are generally favorable for being dryer, with less spray than board sports, boards are more favorable for portability, and in inflatable versions, more easily stowed and carried without special vehicles, trailers or roof racks. Also, boards are generally designed for standing, while boats are generally designed for sitting. Fishing is an option for both, but boats have more capacity for carrying fishing poles and tackle. To enjoy both, it has been customary practice to this point in time to own both a boat and a board.

A need exists for a new type of watercraft capable of bridging the gulf between boards and boats and their respective uses and activities, one that provides aspects of both boards and boats, one that is portable and inflatable and thus easily stowed, carried and inflated for use on any of a wide variety of waters, including lakes, oceans, and rivers.

SUMMARY OF THE INVENTION

An inflatable watercraft according to a particularly preferred embodiment of the invention includes a first inflatable member having a forward end, an aft end, a bottom surface, a top surface and a peripheral side surface between the bottom and top surfaces, and a second inflatable member having a forward end, an aft end, a bottom surface, a top surface and a peripheral side surface between the bottom and top surfaces, wherein the bottom surface of the second inflatable member is positioned in contact with the upper surface of the first inflatable member to define a hull and deck which are rigid when both the first and second inflatable members are inflated.

Preferably, the second inflatable member includes an open space extending from the aft end towards the forward end, which defines a cockpit area when both the first and second inflatable members are inflated and juxtaposed one on top of the other. The first inflatable member includes an open space extending from the aft end towards the forward end, and together with a portion of the open space of the second inflatable member defining an engine well.

The first and second inflatable members are bonded to each other at an interface between the lower surface of the second inflatable member and an upper surface of the first inflatable member. The first and second inflatable members are preferably made of a drop stitch material and are inflatable to air pressures of between 10 and 30 pounds per square inch. Inflation can be achieved by using a high-pressure pump, or a pressurized air tank with capacity to inflate both inflatable members. Gases other than air can be used, including nitrogen and helium, although air is preferred due to cost and availability.

The outer dimensions of the first and second inflatable members are substantially the same, so that when they are vertically and horizontally aligned, a boat is formed having a bow, stern, hull with a substantially flat bottom, and a cockpit.

Preferably, a protective sidewall is bonded to the aligned side surfaces of the first and second inflatable members, to provide protection from abrasion and puncture, and to further bond the first and second inflatable members together. When the Protective sidewall is applied, the two inflatable members, when inflated, appear to be one unit.

The preferred watercraft of the present invention can be provided with a plurality of accessories, including a motor mount detachably connected the watercraft near the engine well. An outboard motor can be provided, so that when mounted on the motor mount, a drive shaft of the outboard motor extends into the water through the engine well. With watercraft having an overall length of up to fourteen feet, a light weight ten horse power engine can be used to propel the watercraft without overpowering the watercraft, and without upsetting balance and stability of the watercraft.

While watercraft having two separate inflatable members is particularly preferred for simplicity, size and weight characteristics, additional inflatable members can be employed. For example, it would be no departure from the invention to include a third inflatable member, of substantially the same size and shape as the second inflatable member, to provide greater freeboard and a deeper cockpit. Moreover, each inflatable member may itself be comprised of separately inflatable chambers or sections, to thereby further enhance the redundancy of buoyancy. In such embodiments, punctures would have diminished adverse effects with greater numbers of separately inflatable sections or chambers. Additional accessories include a storage bag or back pack capable of containing the watercraft when deflated and folded. The watercraft of one particularly preferred embodiment weights fifty pounds or less and can thus be carried in a back pack by a user of average size and strength. Larger watercraft can be made per the present inventions, as for example, those exceeding fourteen feet, but will suffer obvious tradeoffs in weight and ease of deployment, in favor of added load and passenger capacity.

Another aspect of the present invention is to provide a method of making a watercraft comprising the steps of forming a first inflatable member to include a forward end, an aft end, a bottom surface, a top surface and a peripheral side surface between the bottom and top surfaces, forming a second inflatable member to include a forward end, an aft end, a bottom surface, a top surface and a peripheral side surface between the bottom and top surfaces, positioning the bottom surface of the second inflatable member in contact with the upper surface of the first inflatable member to define a hull and deck which are rigid when both the first and second inflatable members are inflated, and bonding the first inflatable member to the second inflatable member.

Preferably the method further comprises forming an open space in the second inflatable member, the open space extending from the aft end towards the forward end and defining a cockpit area when both the first and second inflatable members are inflated.

Another aspect of a preferred embodiment of the present invention is to form an open space in the first inflatable member, the open space extending from the aft end towards the forward end, wherein together with a portion of the open space of the second inflatable member, the open space of the first inflatable member defines an engine well.

To make the first and second inflatable members strong, stiff and subject to inflation at high pressures, it is preferred to make the first and second inflatable members from a drop stitch material, which is capable of being inflated to pressures between 10 and 30 pounds per square inch.

Preferably, the first and second inflatable members have the same outer dimensions, and the method further comprises aligning the side surfaces of the first and second inflatable members vertically and horizontally. Once the first and second inflatable members are aligned and bonded together, the preferred method further comprises bonding a sidewall to the aligned side surfaces of the first and second inflatable members completely around the first and second inflatable members, thereby covering a gap between the side surfaces of the first and second inflatable members, and providing strength and resistance to abrasion and puncture.

It is conceivable that, with the additional sidewall is wrapped completely around the side surfaces of the first and second inflatable members, bonding the sidewall to the first and second inflatable members could dispense with the need to bond the first and second inflatable members at their mutual interface, i.e., at the top surface of the first inflatable member and the bottom surface of the second inflatable member. At the least, the sidewall provides additional bonding between the first and second inflatable members.

Significantly, the watercraft of the present invention can function like a board or a boat, depending on the wishes of the user, and thus, the watercraft has the advantage of being "two in one" with the additional advantage of being completely portable, stowable, easy to deploy, easy to transport, with multiple compound uses which include stand up paddling (for exercise and water transportation), as well as sit down paddling, or just providing a floating platform for performing any number of recreational activities. The watercraft can be stowed on sailboats for use as life rafts or tenders and can be carried in an ordinary automobile on a seat or in the trunk. As a boat, the watercraft can be mechanically powered with an outboard internal combustion engine or with an electric motor. Accessories include a cockpit stand so that while under power, the user can stand and be braced for high speed movement, up to approximately twenty miles per hour. Other accessories include bungie tie downs, D-rings and other devices for holding clothing, electronics, fishing equipment and virtually anything else needed for aquatic sport and/or recreation.

DETAILED DESCRIPTION OF THE PREFERRED EMBODIMENTS

Figure 1:
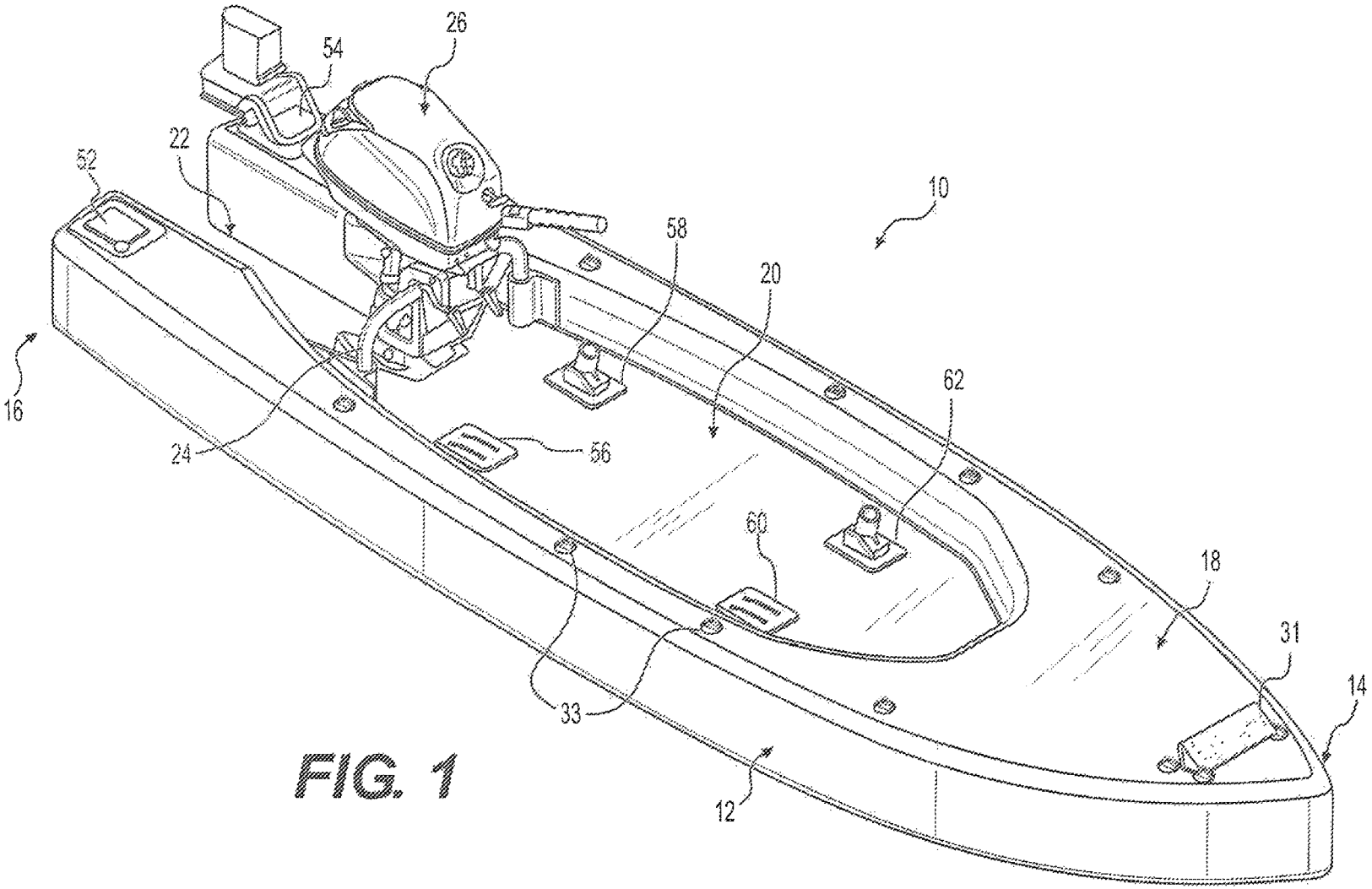
FIG. 1 is a side perspective view of a watercraft according to one embodiment of the present invention.

Referring to FIG. 1, an inflatable watercraft 10 has a hull 12 which includes opposite sides and a bottom, a bow 14, a stern 16, a deck 18, a cockpit 20, and an engine well 22. Optionally, the watercraft 10 includes means for mounting an engine, such as a mounting bracket 24 which supports an outboard motor 26.

In many respects, the watercraft 10 resembles a standard small boat, although most small boats have a transom on which the outboard motor would be mounted. And, while some small inflatable boats are designed to define an engine well between two opposite pontoons, major differences between those and the present invention will become more apparent from the way the watercraft 10 is constructed.

Figure 2:
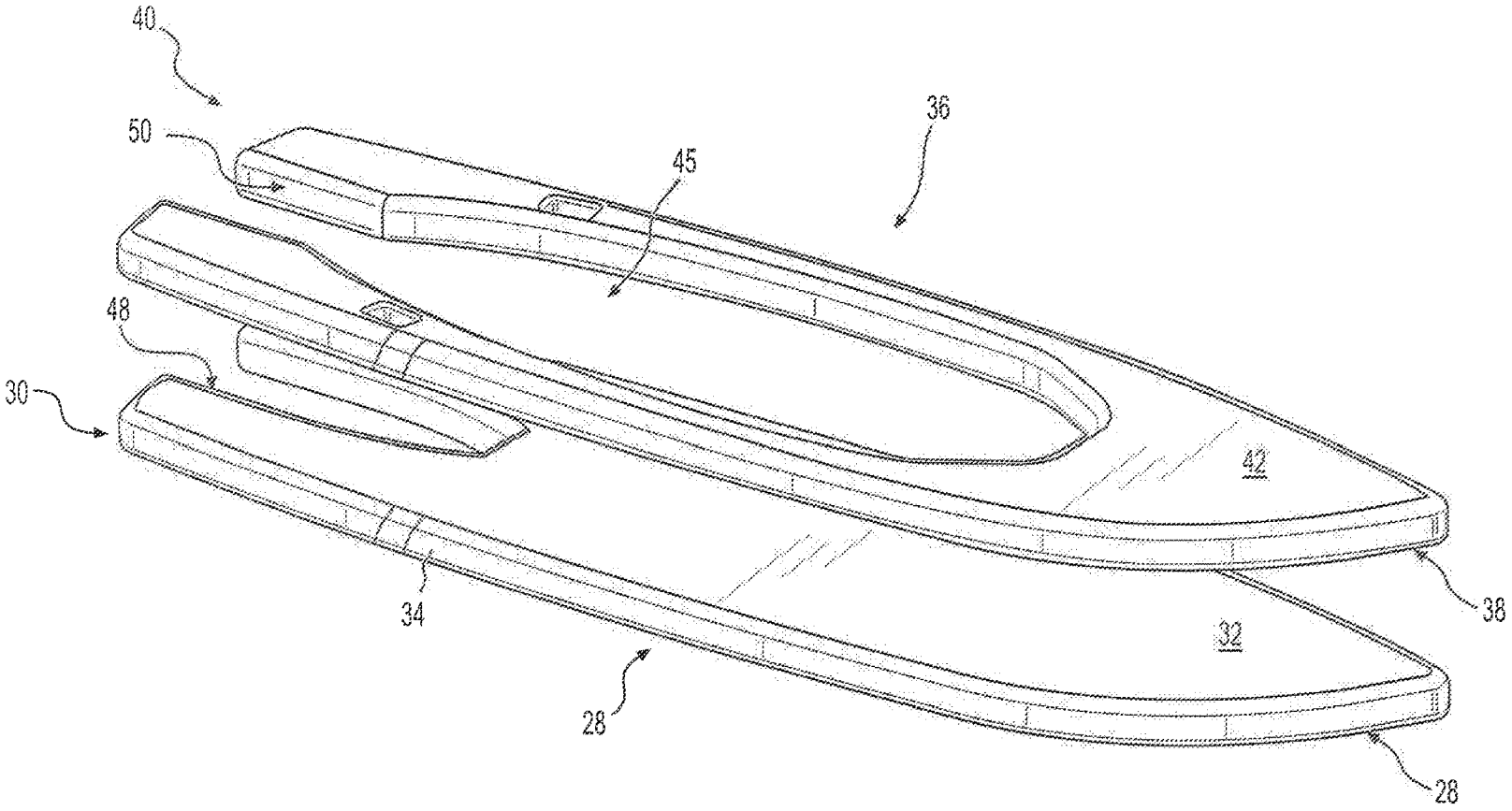
FIG. 2 is a side perspective, exploded view of the two inflatable members which together form the watercraft of FIG. 1.

The watercraft 10 is formed by two separate inflatable members that are bonded together. As seen in FIG. 2, a first inflatable member 28 has a forward end 30, an aft end 30, a bottom surface (not visible in FIG. 2), and a top surface 32. A peripheral side surface 34 extends between the bottom and top surfaces. When inflated, the first inflatable member becomes rigid and strong, substantially to the same degree as a solid, non-inflatable member of comparable dimensions.

A second inflatable member 36 has a forward end 38, an aft end 40, a bottom surface (not visible in FIG. 2), and a top surface 42. A peripheral side surface 44 extends between the bottom and top surfaces. When inflated, the second inflatable member, like the first, becomes rigid and strong.

Figure 3:
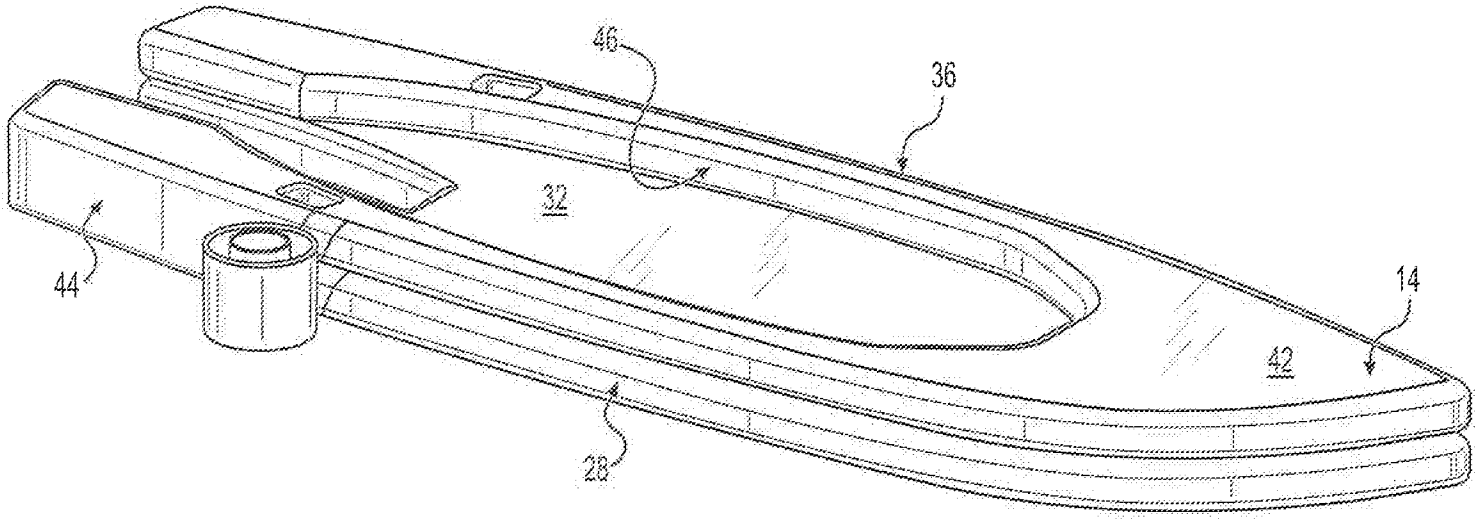
FIG. 3 is a side perspective view of the two inflatable members of FIG. 2, juxtaposed one on top of the other.

As seen in FIG. 3, when making the watercraft 10, the two inflatable members are placed one on top of the other and bonded together. The bottom surface of the second inflatable member 38 is positioned in contact with the upper surface of the first inflatable member 28. The outer dimensions of the two inflatable members are the same and aligned before bonding. Bonding can be by adhesive, heat welding, or any other conventional and known means. Once bonded together, the outer surfaces of the first and second inflatable members form a gap which is covered by a fabric sheet 44 which is preferably waterproof, strong, light and airtight. Such material includes polyvinyl chloride (PVC), PVX, and other comparable materials. More than one layer or more than one sheet 44 can be used. The sheet 44 is wrapped around the outer surfaces and acts as a reinforcement as well as an aesthetic feature of the watercraft. As a reinforcement, the sheet 44 prevents punctures when docking or other maneuvers which may cause the watercraft to come into contact with solid surfaces or other vessels. The sheet 44 also acts to reinforce the bond or connection between the first and second inflatable members 28 and 36. Preferably, the fabric sheet 44 is adhesively bonded to the side surfaces of the first and second inflatable members 28 and 36.

As further seen if FIGS. 1 and 3, the second inflatable member 36 has an elongated opening 45 defined by an inner peripheral edge 46. The top surface 32 of the first inflatable member 28 forms the floor or sole the cockpit 14, the sides of which are defined by the peripheral edge 46. Once assembled, the overlapping forward ends of the first and second inflatable members form the bow 14 of the watercraft 10.

The engine well 22 of FIG. 1 is formed by providing an open space 48 (FIG. 3) in the aft end of the first inflatable member 28. The open space 48 extends from the rearward edge of the first inflatable member 28 towards the forward end for a length sufficient to provide a space through which the shaft of an outboard motor can extend. The engine well 22 is further defined by an open space 50 in the aft end of the second inflatable member 36. The open space 50 extends from the rearward edge of the second inflatable member 36 towards the forward end for a length sufficient to provide a space through which the shaft of an outboard motor can extend. When assembled, the two open spaces 48 and 50, define the engine well 22.

Figure 4:
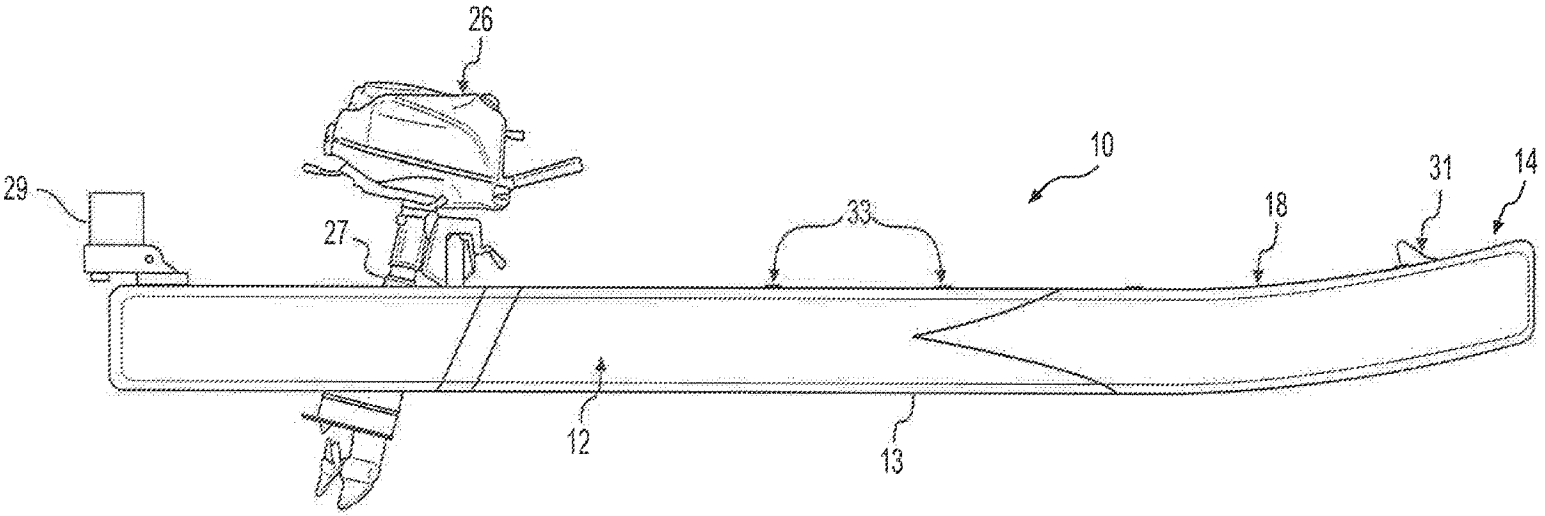
FIG. 4 is a side elevational view of the watercraft of FIG. 1, showing an outboard motor as an accessory, with the drive shaft extending through the engine well.

As seen in FIG. 4, and in one particularly preferred embodiment, the watercraft 10 has an overall length, bow to stern, of twelve feet, although other lengths can be used. With each inflatable member having a thickness of between four and five inches, their combined thickness produces a hull 12 with a freeboard of approximately ten inches and a flat bottom 13. The bow 14 is slightly upturned for stability during forward movement, and the deck 18, like the bottom 13, is substantially flat. The outboard engine 26 has a drive shaft 27 which extends through the engine well 22. Various additional accessories can be attached to the watercraft 10, including a bracket 29 for mounting fishing poles, GPS devices, and cellular telephones. A tow strap 31 is connected to the bow 14, and a plurality of D rings 33 are disposed along the deck 18 to provide various functionality, including as anchoring points for bungle cords or straps to hold down equipment, clothing, and other accessories.

Figure 5:
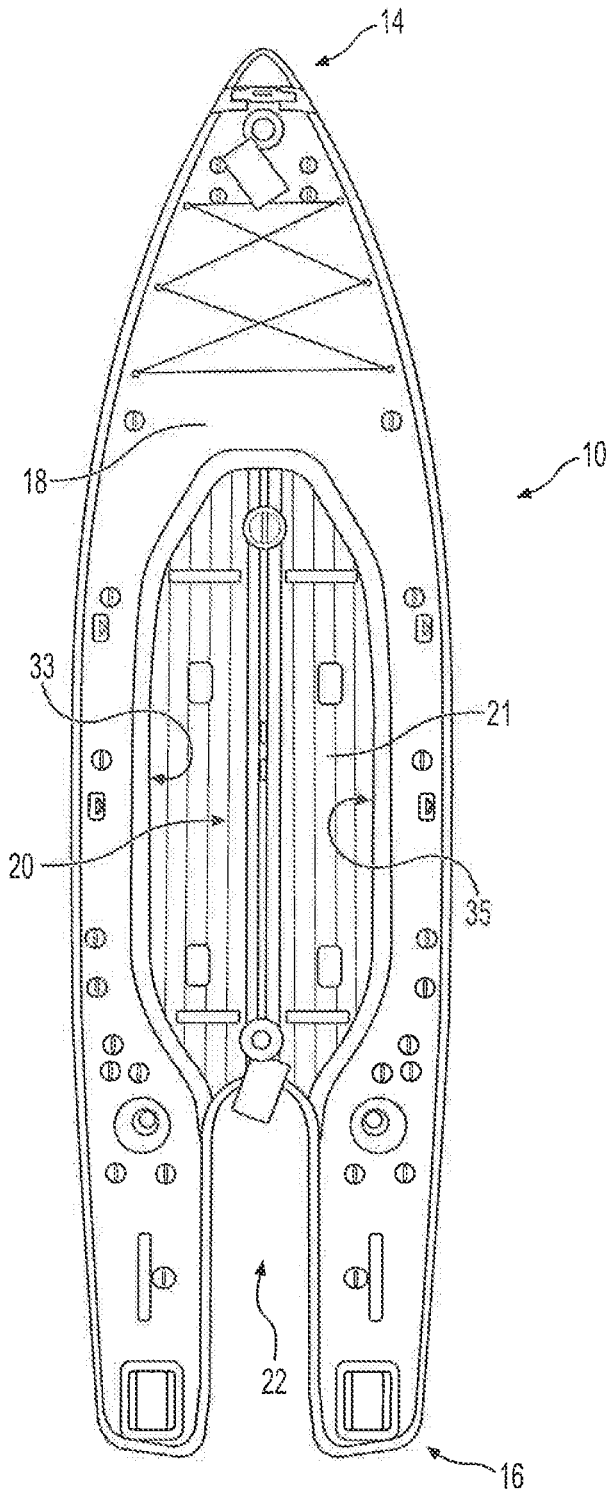
FIG. 5 is a top view of the watercraft of FIG. 1, showing optionally placed D-rings, bungie cords, and a traction pad within the cockpit.

Referring to FIG. 5, the watercraft 10 is shown to have D-rings 33 disposed throughout the deck 18, although the precise number and location of D-rings 33 can be chosen for desired purposes. Also, the floor of the cockpit 20 can be provided with a traction pad 21 which can be patterned to appear like a wooden surface, or otherwise the pad can be textured, or made of non-slippery material to provide grip for a person standing in the cockpit. In that sense, the watercraft is intended to provide SUP functionality, whereby a user can stand in the cockpit and paddle the watercraft with a standard SUP paddle. Although an engine well 22 is provided in the watercraft 10, it is not necessary to provide an outboard motor to use and enjoy the watercraft 10.

When a user opts to use the watercraft 10 as a boat, the cockpit 20 provides a seating area whereby the user can sit on the deck 18 at the forward portion of the cockpit 18, or on top of port and starboard gunnels 33 and 35 formed along opposite sides of the cockpit 18. The gunnels 33 and 35 are formed by the rearward extending portions of the second inflatable member 36.

Optionally, as seen in FIG. 1, the watercraft 10 can be provided with mounting members 52 and 54 at the aft end of the watercraft on opposite sides of the engine well 22, with mounting member 54 supporting the bracket 29. Mounting members 56 and 58, forming one pair, and mounting members 60 and 62, forming a second pair, are provided in the floor of the cockpit 20, to support various accessories. Mounting members 58 and 62 are shown with additional steps or receiving means, to provide quick coupling and release for certain optional accessories, seen in FIG. 6.

Figure 6:
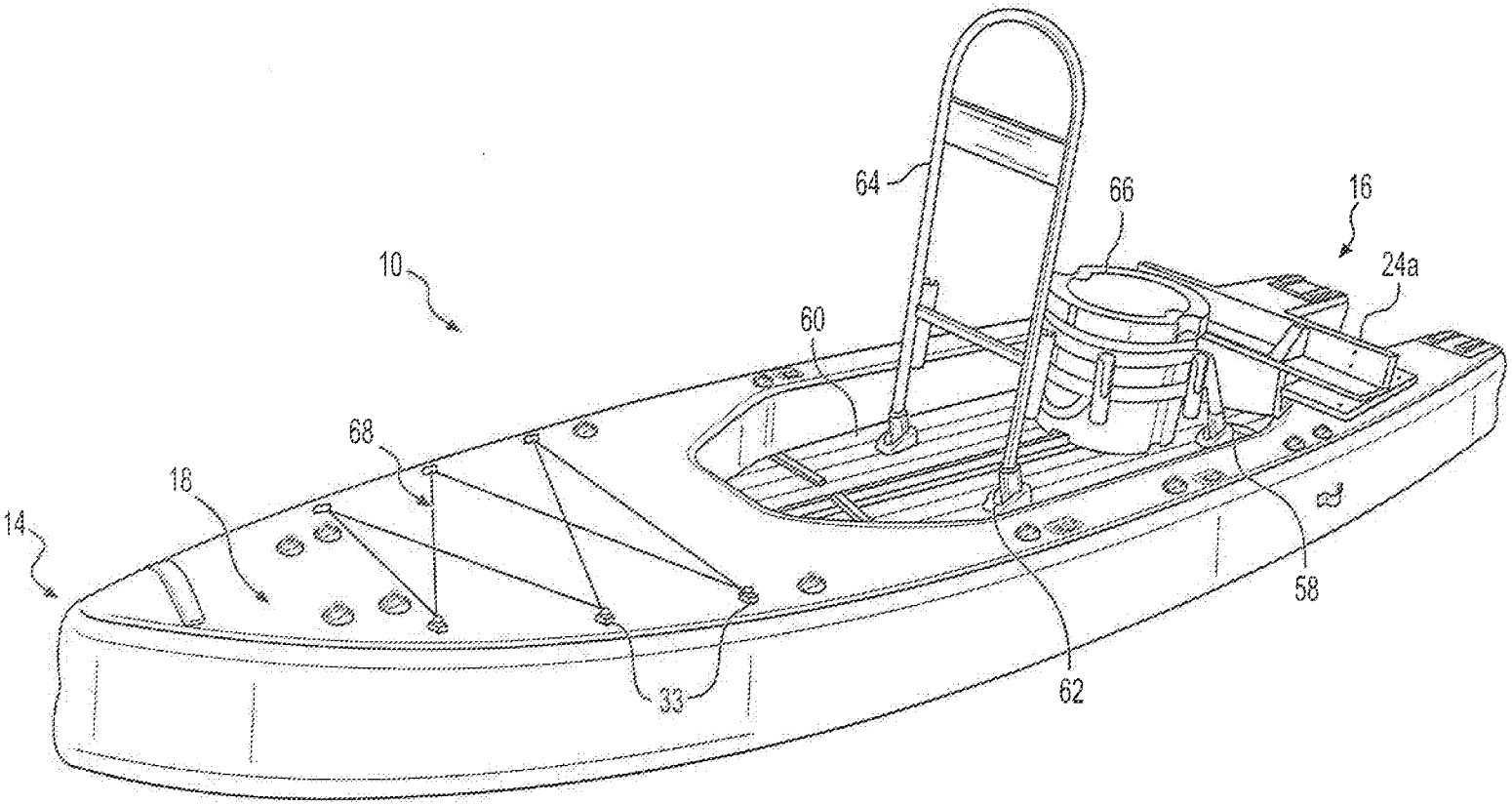
FIG. 6 is a side perspective view of a watercraft of the present invention, showing additional accessories.

The watercraft 10 in FIG. 6 includes a stand-up bar 64, connected to the watercraft 10 through mounting members 60 and 62, so that a user can stand in the cockpit and hold onto the bar 64 for balance and support. A container 66, connected to the watercraft through mounting members 56 and 58, can double as a seat and as a container of fish, clothing, electronics, or virtually anything else. The container 66 is preferably airtight to keep the contents dry. A mounting bracket **24*a*, of different construction from the mounting bracket 24, provides support for an outboard motor, not shown. If an outboard is not used, the mounting bracket may optionally be deployed to provide stiffness between the opposite sides of the engine well. The basic structure of a mounting member includes a reinforced fabric patch of sufficient thickness to prevent tearing or puncturing of the inflatable members when an accessory is attached thereto. A bungie cord 68** is woven between various D-rings and provides a tie-down functionality for equipment of any suitable kind.

Figure 7:
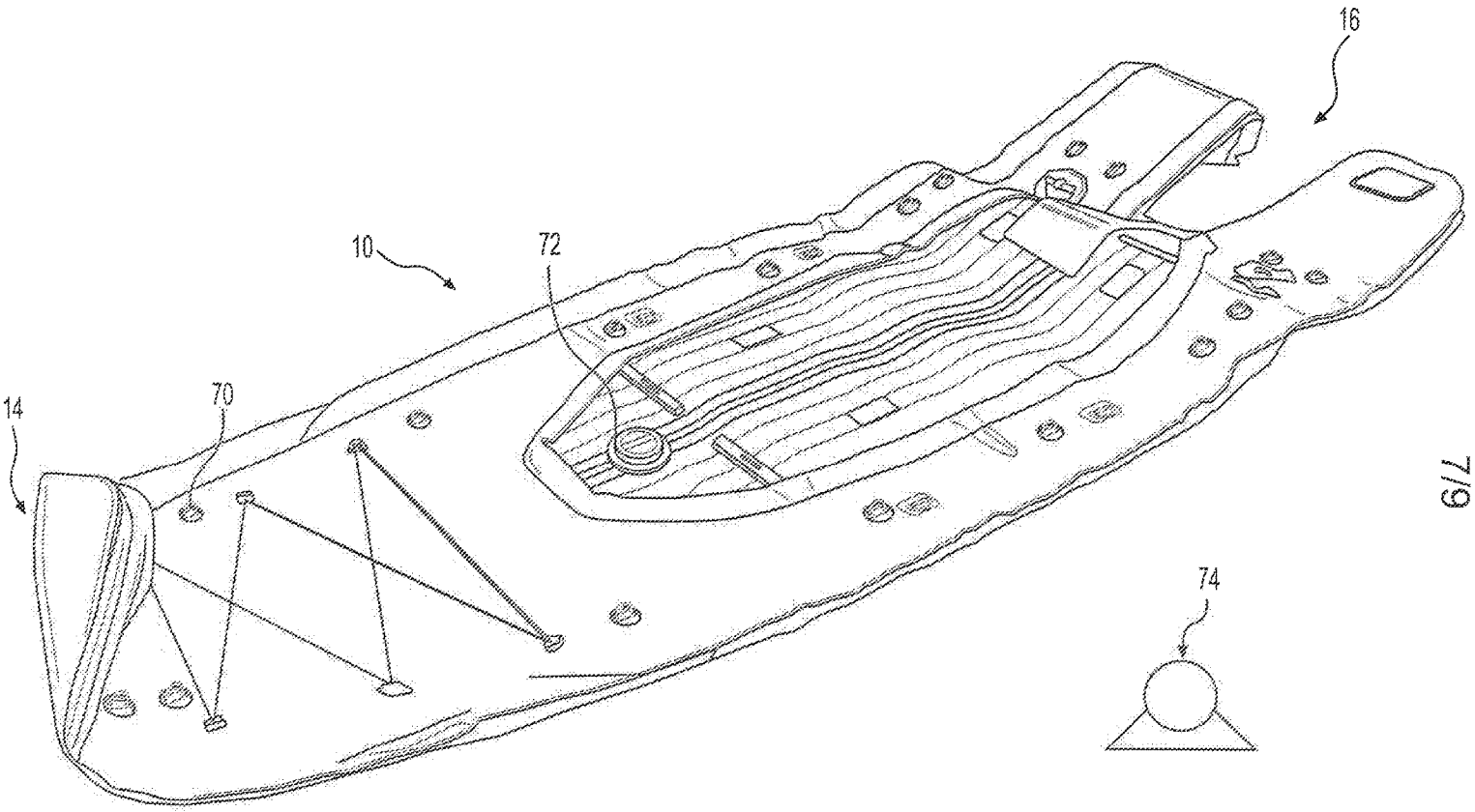
FIG. 7 is a side perspective view of a watercraft of the present invention, in a deflated state.

As seen in FIG. 7, the watercraft 10 is shown in an uninflated state, and rolled out from a folded, stowed disposition. To inflate, two separate inflation valves 70 and 72 are provided, respectively, on each of the first and second inflatable members. In this way, rupture of one inflatable member will not result in total deflation of the watercraft. A high-pressure air pump 74 can be provided as an accessory to connect selectively to the inflation valves 70 and 72 to provide up to 30 pounds per square inch of air pressure. Rapid deflation valves can also be provided as part of the same structure for the inflation valve, or as separate entities at locations convenient to avoid accidental deflation, abrasion, and/or physical damage to the deflation valves.

Figure 8:
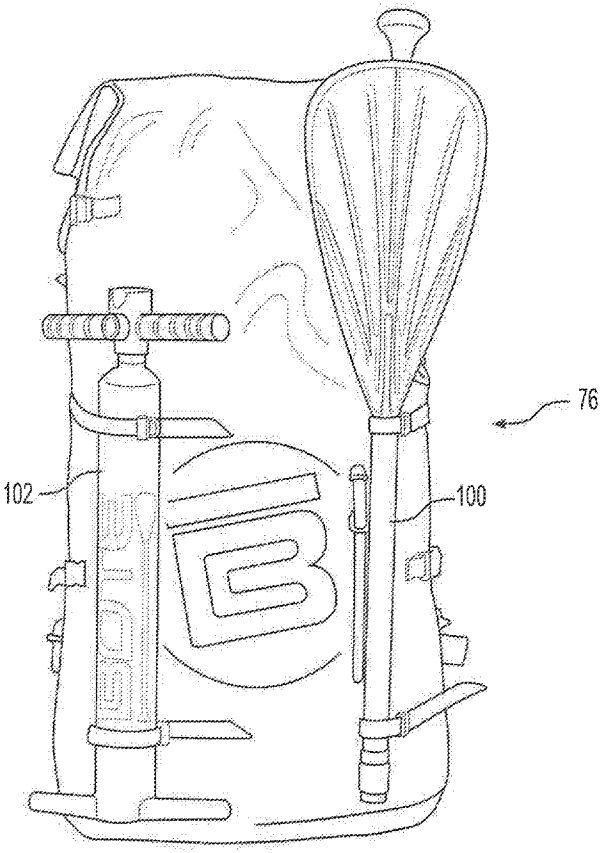
FIG. 8 is a side elevational view of a back pack or stowage bag for containing the deflated and folded watercraft of the present invention.

When deflated, the watercraft 10 can be rolled, and/or folded, into the smallest possible space. As seen in FIG. 8, a back pack or stowage bag 76 is sized and shaped to contain the folded, deflated watercraft 10 of a preferred embodiment of the present invention. It is thus an object, and advantage, of the present invention, to provide a watercraft that is both portable and stowable, and easily transported. Preferably weighing around fifty pounds, the watercraft can be carried as a back pack with shoulder straps.

Figure 9:
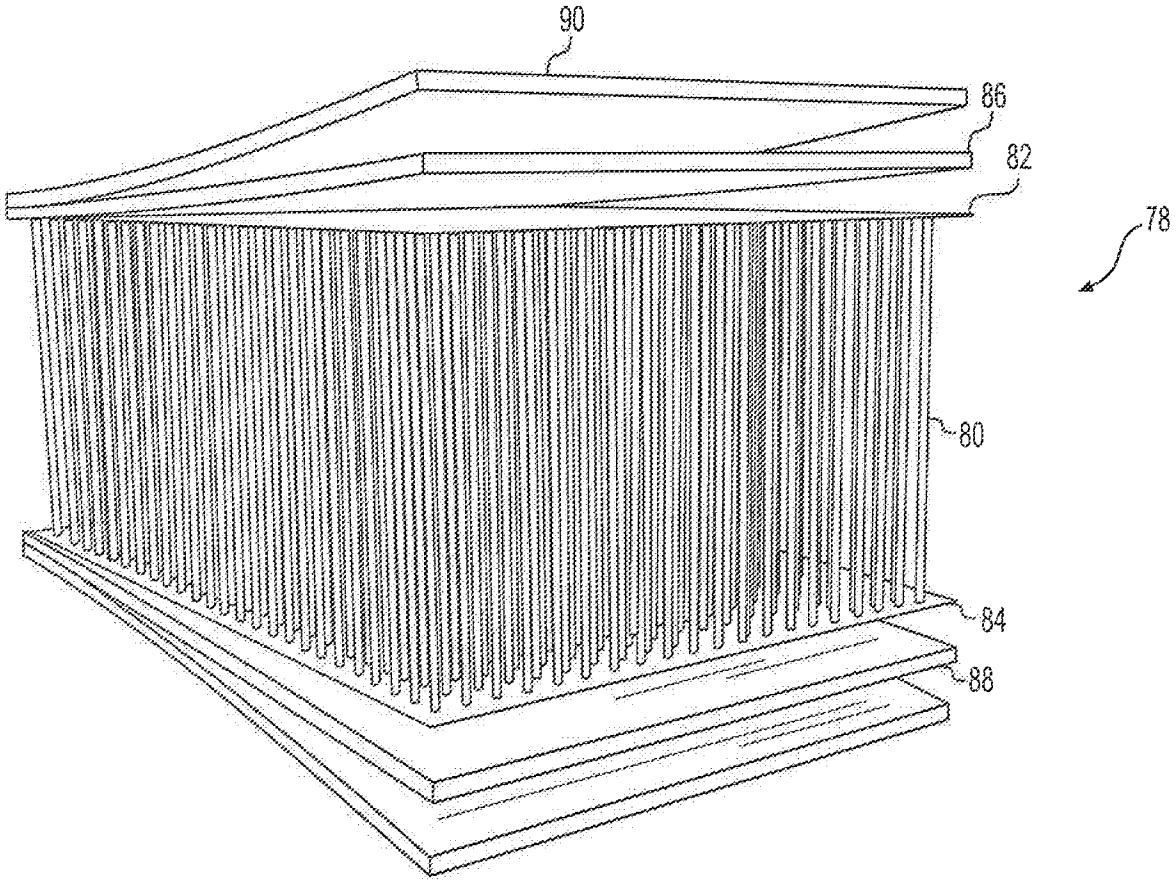
FIG. 9 is a sectional, exploded view of a section of drop stitch material used to make the first and second inflatable members of a preferred embodiment of the present invention.

The preferred embodiments of the present invention use drop stitch material to form each inflatable member. As seen in FIG. 9, the drop stitch material 78 includes a plurality of drop stitch threads 80 that extend between opposing sheets 82 and 84 of composite fabric. Airtight waterproof coatings 86 and 88 are provided on the sheets 82 and 84 for strength. Preferably, a BVA foam pad 90 is adhered to the upper surface of the drop stitch material 78, so as to provide both additional strength and slip proof traction for anyone standing on the upper surface, such as when the upper surface forms the floor of the cockpit, or the deck surface of the watercraft. Various materials can be used, and various manufacturers of drop stitch material exist. The material 78 is chosen to maximize strength for a given preferred weight and overall cost. Drop stitch construction is unique compared to traditional hollow inflatable because the cores can be inflated to much higher PSI (10 to 30 PSI). The result is a much stiffer inflatable platform. The stiffness of this construction allows for the watercraft to be void of any rigid hull parts or sections made of rigid plastic material. This also allows the watercraft to deflate, roll and store in a very small space the size of a roll-on carry luggage.

While the preferred embodiment of the invention utilizes two inflatable members, within reason additional inflatable members can be stacked in similar fashion. Moreover, each inflatable section can be further divided into sections, separately inflated, to further compound redundancy of inflatable chambers. The use of two or more inflatable members of drop stitch material has several advantages over a single layer. First, it can provide a cockpit with near net shape components, thus avoiding forming complicated individual parts or sections. Second, and as mentioned previously, multiple sections provide redundant buoyancy chambers to maintain floatation in the event of a puncture. Generally, the drop stitch material 78 is formed in desirable sizes by welding or bonding the sheets 82 and 84 along a peripheral edge. The bonded seams where the two sheets are joined are preferably further reinforced with a rail tape or other reinforcing structure.

The invention described and claimed herein is not to be limited in scope by the specific embodiments described herein, since these embodiments are intended to be illustrative, not exhaustive, examples of the present invention. Various modifications of the aforementioned embodiments, in addition to those shown and described herein will become apparent to those skilled in the art from the foregoing description. Such modifications naturally fall within the scope of the appended claims.

What is claimed is:

1. An inflatable watercraft comprising:

a first inflatable member having a forward end, an aft end, a bottom surface, a top surface and a peripheral side surface between the bottom and top surfaces; and a second inflatable member having a forward end, an aft end, a bottom surface, a top surface and a peripheral side surface between the bottom and top surfaces, wherein the bottom surface of the second inflatable member is positioned in contact with the upper surface of the first inflatable member to define a hull and deck which are rigid when both the first and second inflatable members are inflated, the second inflatable member includes an open space extending from the aft end towards the forward end, and defining a cockpit area when both the first and second inflatable members are inflated, and the first inflatable member includes an open space extending from the aft end towards the forward end, and together with a portion of the open space of the second inflatable member defining an engine well.

2. The inflatable watercraft of claim 1, wherein the first and second inflatable members are bonded to each other at an interface between the lower surface of the second inflatable member and an upper surface of the first inflatable member.

3. The inflatable watercraft of claim 1, wherein the first and second inflatable members are made of a drop stitch material.

4. The inflatable watercraft of claim 3, wherein the first and second inflatable members are inflatable to air pressures of between 10 and 30 pounds per square inch.

5. The inflatable watercraft of claim 1, wherein the peripheral side surfaces of the first and second inflatable members are vertically and horizontally aligned.

6. The inflatable watercraft of claim 5, further comprising a sidewall bonded to the aligned peripheral side surfaces of the first and second inflatable members.

7. The inflatable watercraft of claim 1, further comprising an pump capable of generating air pressure in a range of 10 to 30 pounds per square inch.

8. The inflatable watercraft of claim 1, further comprising a storage bag capable of containing the first and second inflatable members when deflated.

9. The inflatable watercraft of claim 1, further comprising a mounting bracket for supporting an outboard motor, the mounting bracket being configured for detachably connecting to the inflatable watercraft near the engine well.

10. The inflatable watercraft of claim 9, further comprising an outboard motor having a drive shaft configured to extend through the engine well when the outboard motor is mounted on mounting bracket.

* * * * *